United States Patent [19]

Jarvis

[11] 4,360,980

[45] Nov. 30, 1982

[54] BACKHOE ADAPTER

[75] Inventor: Jack D. Jarvis, Memphis, Tenn.

[73] Assignee: Aluma Form, Inc., Memphis, Tenn.

[21] Appl. No.: 190,200

[22] Filed: Sep. 24, 1980

[51] Int. Cl.[3] ..... E02F 3/76

[52] U.S. Cl. ..... 37/117.5; 37/DIG. 12; 37/141 R; 172/701.1; 403/334; 414/724

[58] Field of Search ..... 37/103, 117.5, DIG. 3, 37/DIG. 12, 142 R, 142 A, 141 R, 141 T; 172/701.1, 701.3, 719, 197; 414/724; 403/333, 334, 44, 43, 45, 46, 47

[56] References Cited

U.S. PATENT DOCUMENTS

| | | | |
|---|---|---|---|
| 2,737,006 | 3/1956 | Klingler | 37/142 R X |
| 3,034,237 | 5/1962 | Wolfe et al. | 37/117.5 |
| 3,469,330 | 9/1969 | Hood et al. | 37/117.5 |
| 3,922,745 | 12/1975 | Lehman | 37/103 X |
| 3,942,271 | 3/1976 | George | 37/117.5 |
| 4,048,938 | 9/1977 | Patterson et al. | 403/43 X |
| 4,130,269 | 12/1978 | Schreyer | 403/45 |
| 4,208,815 | 6/1980 | Yunker et al. | 37/142 R X |

*Primary Examiner*—Edgar S. Burr
*Assistant Examiner*—Moshe I. Cohen
*Attorney, Agent, or Firm*—Paul M. Denk

[57] ABSTRACT

This invention comprises an adapter for connection with a backhoe bucket, and includes a blade member having an inclined plate secured thereto to form a wedge into which the teeth of the bucket may insert, while ratchet and turnbuckle combinations connect with the adapter, extend upwardly along either side of the bucket, and are secured by means of a cross bar, or other clamping means, to the upper back side of the bucket, and when tightened assure the firm retention of the adapter upon the backhoe as during its use for tamping, slicing, grading, or other work upon the soil.

14 Claims, 10 Drawing Figures

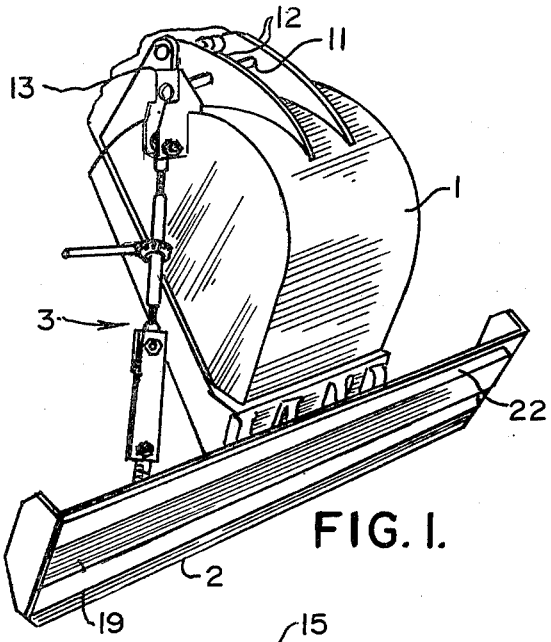
FIG. 1.
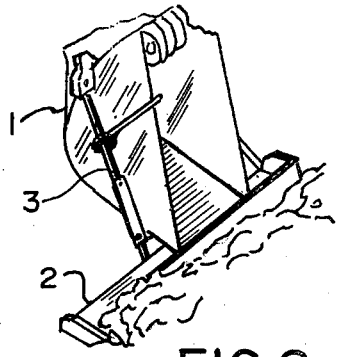
FIG. 2.
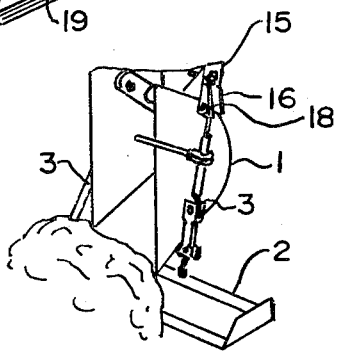
FIG. 3.
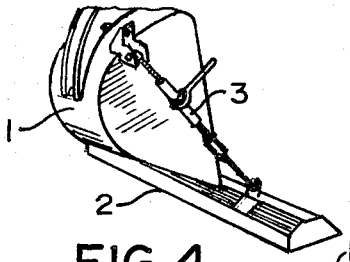
FIG. 4.
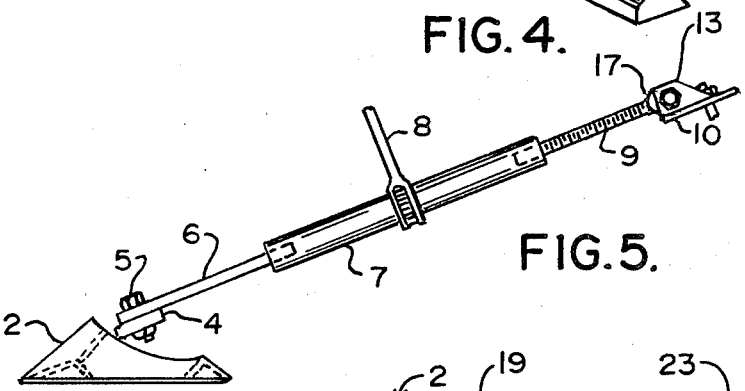
FIG. 5.
FIG. 6.
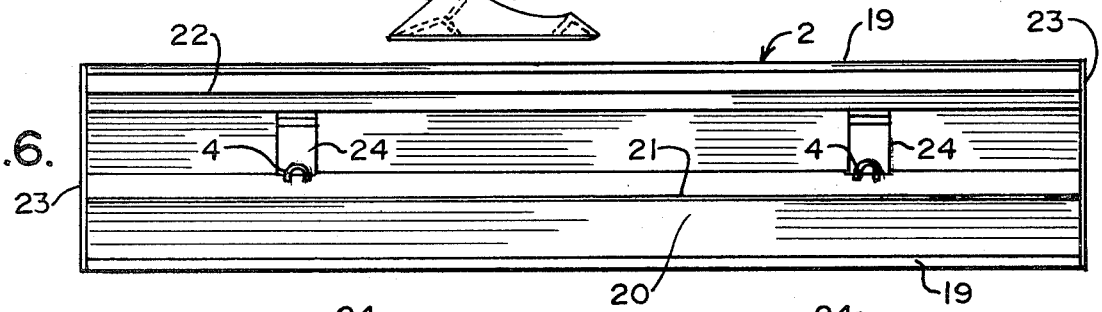
FIG. 7.
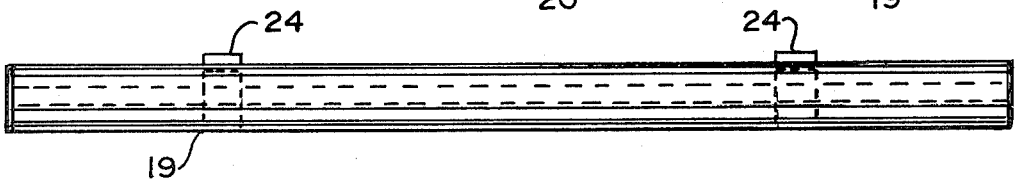
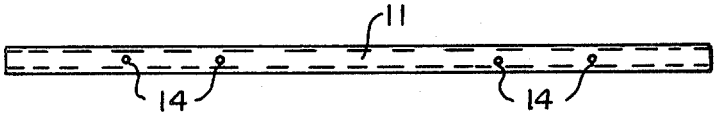
FIG. 8.

BACKHOE ADAPTER

BACKGROUND OF THE INVENTION

This invention relates generally to an attachment to a backhoe which makes it much more versatile in usage, expanding its operations for application in scraping, tamping, grading, and other movements of the earth.

Numerous styles of implements or attachments to the bulldozer blade, backhoe bucket, and other implements that normally attach through a three point or other hitch to a tractor, or the like, have been developed in the prior art. Most of these attachments are effective for their intended purpose, but the current invention is devised to provide for more widespread usage of an adapter for connecting with a backhoe bucket, for performing a multitude of operations upon the ground, and even more significantly, be utilized and installed upon buckets of varying sizes.

Examples of what are known in the prior art, as previously explained, are disclosed in the Smith, U.S. Pat. No. 2,644,251, showing a backfilling attachment for connection directly with the front of a power shovel. As can be seen, the principal limitation upon this device is that it must be connected with a shovel of particular width, and which cannot vary from that dimension. The U.S. Pat. No. 2,433,019, to Arps, discloses a combination for a scoop, bulldozer, and scraper, wherein this scraper blade is connected by means of side mounting members to the hitch means extending from the back side of a tractor. One of the main differences between the device of Arps, and that which has been designed as the current invention, is that the former instrument is mainly functionable as a scraper or scoop, does not have a frontal blade that allows it to be used as a grader, and in addition, is not attachable on to the bucket of a backhoe per se, much less buckets of varying widths and sizes.

The U.S. Pat. No. 3,109,248, to Vos, discloses a bucket grader attachment, one that is connected directly onto the frontal disposed bucket of a front end loader, and in this instance, the attachment includes integral shield and heel portions that are also welded or secured at the back edge of the bucket, or to the bottom wall of the same. While the shown attachments may be useful for allowing the application of its bucket as a grader in either direction of movement, it is to be noted that these attachments are permanently affixed to the bucket, and not replaceable as in the current invention. The Discenza, U.S. Pat. No. 3,181,256, shows a backfilling blade for a power shovel, with the shown attachment being not too unlike that as shown in the earlier described Smith patent. In addition, the second U.S. Pat. No. 3,043,032, to Discenza, discloses another form of blade attachment for securement with the power shovel, and while positions may be provided for locating of the teeth of the Discenza bucket within a portion of the shown blade, the blade itself includes side attachment means that are fixed in position, thereby limiting the application of the blade to a shovel of only a singular dimension.

The U.S. Pat. No. 3,469,330, to Hood, discloses another form of a blade that is secured upon the front of a backhoe bucket, with the teeth of the bucket being insertable within fixed pockets formed upon the backside of the shown blade attachment. Obviously, this blade is designed specifically for use with a singular dimensioned bucket.

Other patents showing related type of backhoe attachments are set forth in the George, U.S. Pat. No. 3,942,271, the Nault, U.S. Pat. No. 3,967,397, the Johnson, U.S. Pat. No. 4,009,529, and finally, the U.S. Pat. No. 4,081,919, to Teach.

In view of the foregoing, it is the principal object of this invention to provide a more universal form of attachment for connection with the backhoe and which can expand the usefulness of the backhoe in its operations to perform other than digging functions.

A further object of this invention is to provide a backhoe attachment that can turn a backhoe into a scraper.

A further object of this invention is to provide a backhoe attachment that can convert it into an earth tamper.

Yet another object of this invention is to provide a backhoe attachment that can convert it into a dirt pusher.

Still another object of this invention is to provide a backhoe attachment that can be used as an earth puller.

Still another object of this invention is to provide an attachment for a backhoe that can convert it into a sod cutter.

Yet another object of this invention is to provide an attachment to a backhoe that finds utility as a backfilling scraper.

Still another object of this invention is to provide an attachment that can function as a shovel.

Still another object of this invention is to provide an attachment that can function as a valley trencher.

A more significant function of this invention is to provide an attachment for a backhoe that can function as a grader.

Still another object, and a significant one, is to provide an attachment to a backhoe that is universal of application, and can be installed upon most backhoe buckets currently in use, regardless of their varying dimensions.

Yet another object of this invention is to provide an attachment for a backhoe that is constructed of relatively few parts, can be quickly installed generally in less than a minute, but yet is sufficiently rigid and sturdy in construction to withstand the heavy impacting forces exerted upon the backhoe bucket during its usage.

These and other objects will become more apparent to those skilled in the art upon reviewing the summary of this invention, and upon undertaking a study of its preferred embodiment in view of the drawings.

SUMMARY OF THE INVENTION

This invention contemplates the formation of an attachment that may be connected directly with the backhoe bucket, tightened in place through the application of readily available ratchets, and perform the variety of functions as previously enumerated as objectives in its usage. The adapter incorporates a blade member that extends laterally to either side of the bucket, has a series of formed bosses provided therein for both reinforcement purposes, and to provide location for connection of other braces to the same. Extending upwardly and rearwardly from the frontal formed boss of the blade member is an inclined plate, with a combination of the inclined plate and the frontal portion of the blade member forming a scraping edge that is useful for scraper purposes, sod cutting purposes, or for smooth slicing of a layer of earth during its application.

Side walls are provided to either side of the blade member, and its attached inclined frontal plate, in order to stabilize and reinforce the adapter in its structure.

Connecting with the approximate side of the adapter, and more specifically to either its blade member or to the inclined plate, are a pair of turnbuckles, one to either side, which have ratchets secured therewith, with the upper end of the turnbuckle being disposed for attachment by means of clips, through the use of a cross bar, or any other means for bolting or otherwise securing the adapter to the backside of the bucket, diametrically arranged with respect to the locating of the bucket teeth within the wedge shaped opening formed within the adapter and which functions as the positioning means into which said teeth locate intermediate the blade member and its inclined plate, during its installation and usage. The cross bar, where this means for fastening is utilized, can be journaled through reinforcing structure provided normally at the back side of a backhoe bucket, and by connecting each of the turnbuckles to this cross bar, and affixing them thereto either by means of nuts that may thread onto opposite ends of the cross bar, or through the use of cotter pins, or other positioning means, through a tightening of the disposed ratchets the adapter becomes quickly secured rigidly to the backhoe bucket, and ready for usage.

BRIEF DESCRIPTION OF THE DRAWINGS

In the drawings,

FIG. 1 discloses an isometric view of the backhoe bucket having the adapter secured therewith;

FIG. 2 discloses the similar combination shown in FIG. 1 and revealing the use of the adapter as an earth cutter;

FIG. 3 provides another isometric view of the combination of FIG. 1 showing them in usage;

FIG. 4 discloses an oblique backside view of the combined backhoe bucket with the adapter attached thereto;

FIG. 5 provides a side view of the adapter and its turnbuckle and ratchet combination;

FIG. 6 discloses a top plan view of the adapter;

FIG. 7 provides a front edge view of the adapter;

FIG. 8 discloses a cross bar, which may be used for securement of the adapter with the backhoe bucket;

DESCRIPTION OF THE PREFERRED EMBODIMENT

Figure 10:
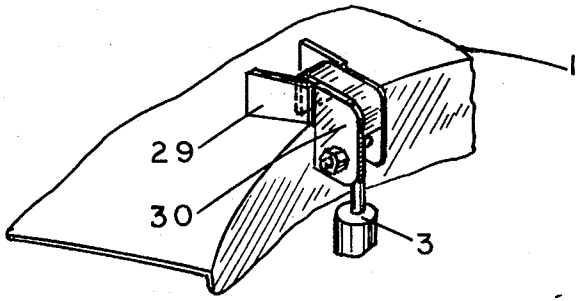
FIG. 10 shows a modification for clamping the adaptor onto the upper edge of the backhoe bucket.

In referring to the drawings, and in particular FIGS. 1 through 4, there is shown the backhoe bucket 1 having the adapter 2 installed upon it, being secured in place by means of the link means 3, one being provided to either side of the bucket.

In referring to FIG. 5, it can be seen that the adapter has connected to it a tab 4, with the links being secured to each tab, through the agency of the fastener means or bolt 5, through its threaded shank 6, as shown. A turnbuckle 7 is threadedly connected to the member 6, and is disposed for being turned by means of a ratchet 8. Connecting threadedly with the upper end of the turnbuckle 7 is another threaded shank 9 with this shank having at its upper end a connection means 10 which secures to the upper backside of the bucket 1, as shown in FIG. 1. This means for connecting each side ratchet-turnbuckle combination to the upper side of the bucket may comprise any form of fastening that may rigidly secure the upper end of the combination thereto, and this may be performed through the use of clamps, clips, bolts, or the like. In this embodiment, as shown, a cross bar 11 is journaled through a pair of apertures provided through the integral back reinforcement bracings 12 of the bucket, and having the attaching clips 13 secured thereon, and held in place by bolts, or perhaps cotterpins, or the like. The cross bar 11 is more specifically shown in FIG. 8, and has a series of apertures, as at 14, provided therethrough for accommodating cotterpins, positioning pins, or the like, so as to hold the clips 13 of the ratchet-turnbuckle combination in place upon the cross bar once located.

Each clip 13 that attaches with the cross bar includes an upstanding flange 15, which is then integrally formed into a pair of ears, as at 16, through which aligned apertures are provided, and through which the upper eyebolt 17 of the threaded shank 9 may be located, with a bolt 18 provided therethrough for securing the same together. When positioned in this manner, it can be seen that the upper end of the threaded shank 9 can be pivoted outwardly, in the event that a more widened bucket is being attached with the adapter, or in the alternative, it may be pivoted inwardly, to accommodate a narrower bucket design.

Figure 9:
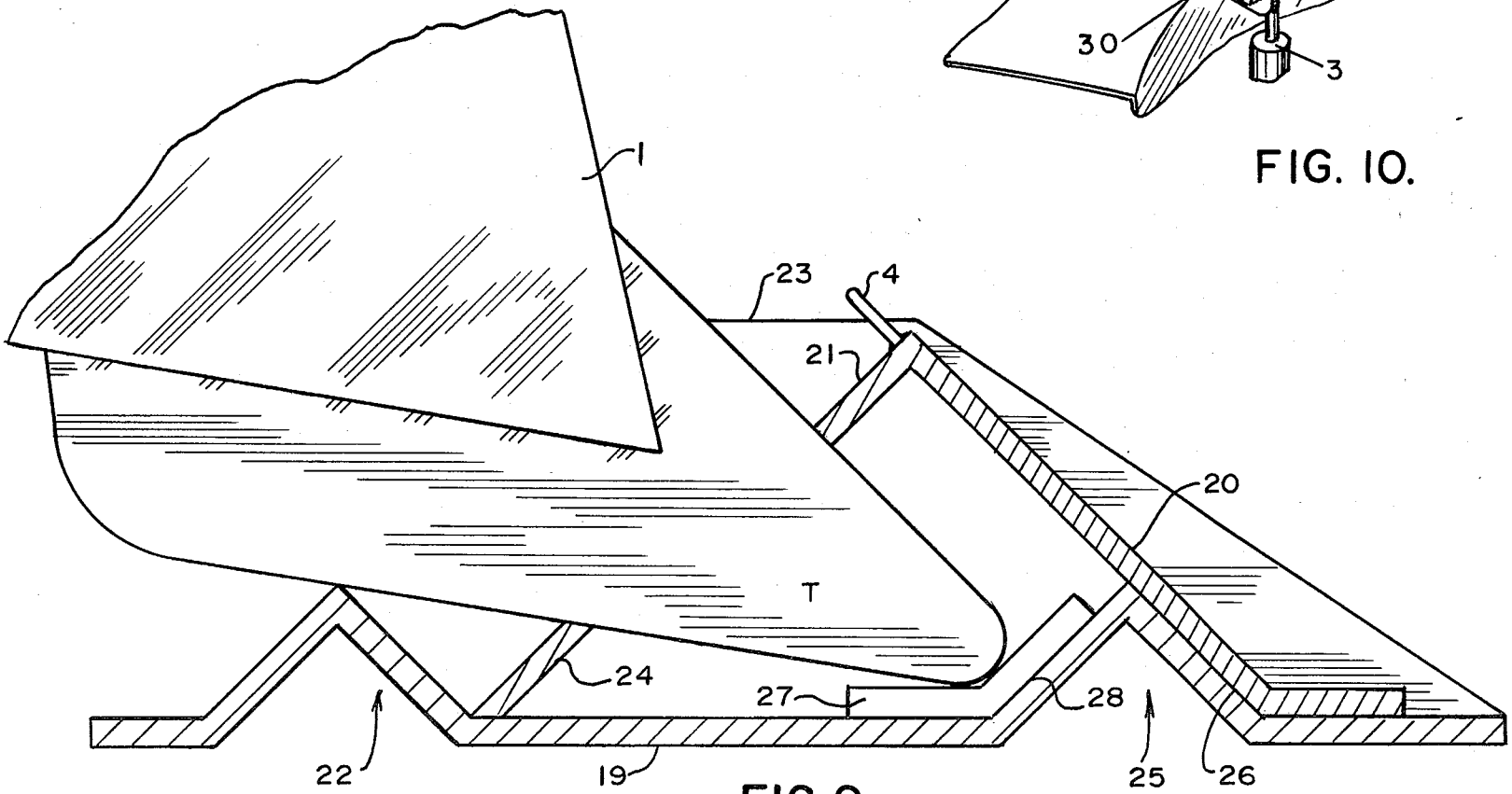
FIG. 9 shows a sectional view of the adapter disclosing the wedging of the backhoe bucket teeth within the adapter during its usage.

The specific construction of the adapter itself, in addition to FIG. 1, is more accurately shown in FIGS. 6, 7, and 9. As can be seen, the adapter comprises a blade member 19 which has an inclined plate 20 extending upwardly and rearwardly from approximate the frontal edge of said blade member, and which place is bent downwardly and rearwardly, as at 21, for forming one of the bearing points that contacts against the teeth of the bucket in a manner as will be subsequently described. The back portion of the blade member 19 is bent into the configuration of a boss, as at 22, forming an integral inverted V within the formation of the said blade member. This inclined plate 20 extends upwardly and rearwardly upon an incline forming an angular relationship of between about 40° to 50° with the said blade member 19. Provided at either end of the blade member, and the inclined plate 20, are side walls 23, to provide greater rigidity to the formation of the adapter, and to provide full structural containment of the adapter when tightly mounted upon the teeth of the backhoe bucket. A pair of additional braces 24 secure between the inclined flange 21 of the plate 20, and the configured boss 22, to provide further structural rigidity at these locations, particularly where the tabs 4 connect with the two ends of the ratchet-turnbuckle combinations that secure with the said adapter.

The more specific construction of the adapter is shown in the sectional view provided in FIG. 9, and it can be seen that the blade member 19 has the configured or bent boss 22 provided proximate its back edge, while a similar type of boss is bent into the configuration as shown at 25. Extending upwardly from the frontal surface 26 of the formed boss is the inclined plate 20, having its bent flange 21 extending that distance which provides for its snug contact against the upper surface of the teeth of the bucket 1. In addition, a toe plate 27 is provided internally along the surface 28 of the formed boss 25, in addition to overlying an internal part of the blade member 19, and provides the third point at which the frontal portion of the teeth T bias against the adapter during its installation upon the bucket 1 of the backhoe. Thus, there is a three point contact of each tooth T within the configured adapter, that snugly embrace the teeth T of the backhoe bucket, and assure its retention therein through the tightening of the ratchets 8 provided to either side of the bucket 1, as shown previously in FIGS. 1 through 4. In addition, the sidewalls 23 are shown being connected at the ends of the blade member 19, in addition to the inclined plate 20, to provide that needed rigidity at the end locations of the adapter, to assure its stability. In addition, a part of one of the braces 24 that provide intermediate structural retention of the various components of the adapter together is also shown.

FIG. 10 discloses a more modified manner for connection of the adaptor to the backhoe bucket. As can be seen, the bucket 1 has welded or otherwise secured to its upper edge proximate each side a member to which a clamp may secure, which in this instance, the member comprises a U-shaped segment of metal 29, one of each being welded to either side of the bucket proximate the same location where the cross bar 11 had previously been arranged. Then, a clamp or hooking member 30, which is pivotally mounted to the upper edge of the link means 3, and which incorporates a formed bent down tab 31, is arranged for hooking onto the U-shaped member 29, with one of these links being arranged to either side of the said bucket, and once the links are tightened, through the turning of their ratchet 8, the adaptor can be rigidly secured to the backhoe bucket, as aforesaid.

Various modifications or variations to the construction, and attachment, of the adapter of this invention to the backhoe bucket may occur to those skilled in the art upon reviewing the subject matter of this description. Such variations or modifications, if within the spirit of this invention, are intended to be encompassed within the scope of any claims to patent protection issuing hereon. The analysis of the invention as set forth herein is primarily set forth for illustrative purposes only.

Having thus described the invention what is claimed and desired to be secured by Letters Patent is:

1. An adapter for use in conjunction with a backhoe bucket having teeth and being attachable with the three point or other hitch of a tractor or the like, and useful for tamping, scraping, grading, or performing other operations upon the ground, comprising, a blade member, an inclined plate secured proximate the front of said blade member and extending upwardly at a rearward angle therefrom, side walls connecting at either side of the said blade member and plate to rigidify the adapter, the combination of said blade member and plate forming a space to accept the said bucket teeth in a wedging action to enhance their retention, adjustable link means connecting with the said adapter and embracing the bucket to assure the stable retention of the adapter with said backhoe during usage, said blade member including a pair of bosses formed therein upon the said blade member, the combination of said bosses, blade member, and inclined plate being arranged for forming three point contact with the bucket teeth when securing the adapter with the backhoe, one of said bosses being arranged proximate the rear of the blade member and the other of said bosses being arranged proximate the front of said blade member.

2. The invention of claim 1 and wherein said inclined plate being bent at its upper edge to reinforce it at this location and to provide a contact point for the adapter inserted bucket teeth.

3. The invention of claim 1 and wherein said adjustable link means connects with the adapter at a position spacedly from the sides of the bucket in order to accommodate buckets of varying sizes in their connection with the said adapter.

4. The invention of claim 3 and including braces securing with the inclined plate and the blade member proximate the location of the connection of said link means with the adapter to furnish reinforcement at these locations.

5. The invention of claim 1 and wherein said inclined plate is secured to the front formed boss of the blade member.

6. The invention of claim 5 and wherein the frontal portion of the blade member forwardly of the front boss forms a scraper blade.

7. The invention of claim 1 and wherein each formed boss of the blade member is created from a series of integral bends made in the said blade member.

8. The invention of claim 7 and wherein each bend formed boss extends from side to side of the adapter blade member.

9. The invention of claim 7 and wherein the incline plate is secured to the front formed boss, and extends upwardly and rearwardly upon an incline for forming an angular relationship of between about 40° to 50° with the said blade member.

10. The invention of claim 9 and including a toeplate secured to the blade member and the back surface of the front formed boss and therein functioning as wear surface against which the front edge of the bucket teeth impact during installation and usage of the said adapter.

11. The invention of claim 1 and wherein said adjustable link means includes at least one ratchet and turnbuckle combination provided to either side of the bucket and when tightened securing the adapter in place.

12. The invention of claim 1 and wherein said turnbuckle can be loosened for facilitating removal of the adapter.

13. The invention of claim 11 and including a cross bar associated with the back of said bucket, and said cross bar connecting with each ratchet and turnbuckle combination for securing the adapter with the said bucket.

14. The invention of claim 11 and including a fastening member secured to the backside of the backhoe bucket, one said clamping member being arranged at approximately each of its side edges, each adjustable link means having a hook member arranged approximate its upper end, and said hooking members provided for securing onto the clamping members of the backhoe bucket and being rigidly adhered thereto upon adjustment of the link means into their tightened disposition.

* * * * *

UNITED STATES PATENT AND TRADEMARK OFFICE

CERTIFICATE OF CORRECTION

PATENT NO. : 4,360,980

DATED : November 30, 1982

INVENTOR(S) : Jack D. Jarvis

It is certified that error appears in the above—identified patent and that said Letters Patent is hereby corrected as shown below:

Column 6, Claim 12, line 1, delete "1", and insert therefor ---11---.

Signed and Sealed this

*Eighth* Day of *March 1983*

[SEAL]

*Attest:*

GERALD J. MOSSINGHOFF

*Attesting Officer*

*Commissioner of Patents and Trademarks*